United States Patent [19]

Rodier

[11] 4,145,391

[45] Mar. 20, 1979

[54] CELLULOSE FIBER PROCESS

[75] Inventor: Henry Rodier, Sainte-Foy-Les-Lyon, France

[73] Assignee: Rhone Poulenc Textile, Paris, France

[21] Appl. No.: 854,401

[22] Filed: Nov. 23, 1977

[30] Foreign Application Priority Data

Nov. 26, 1976 [FR] France ..... 76 35988

[51] Int. Cl.[2] ..... D01F 6/18; C08L 1/24

[52] U.S. Cl. ..... 264/83; 106/163 R; 106/168; 264/207

[58] Field of Search ..... 264/187, 188, 207, 83; 106/168, 163 R; 8/116.4

[56] References Cited

U.S. PATENT DOCUMENTS

| | | | |
|---|---|---|---|
| 759,332 | 5/1904 | Waite | 264/83 |
| 842,125 | 1/1907 | Vittenet | 264/83 |
| 849,823 | 4/1907 | Waite | 264/83 |
| 1,652,206 | 12/1927 | Lehousse | 264/207 |
| 1,881,742 | 10/1932 | Lilkenfeld | 264/83 |
| 4,022,631 | 5/1977 | Turbak et al. | 106/168 |
| 4,028,132 | 6/1977 | Litt et al. | 106/163 R |

*Primary Examiner*—Jay H. Woo

*Attorney, Agent, or Firm*—Murray & Whisenhunt

[57] ABSTRACT

A process for producing shaped articles of cellulose is disclosed, wherein a solution of cellulose in dimethylsulphoxide (DMSO) and formaldehyde, at a formaldehyde/cellulose weight ratio of 0.2 to 2, and at a cellulose concentration of at least 6% by weight, based on the volume of DMSO, is spun into a gaseous atmosphere containing ammonia.

The process of the present invention permits the cellulosic solution to be formed into shaped articles in a very rapid and economical manner. The invention is especially useful in the production of filaments which can be used in the textile field, but other shaped articles, such as fibers, threads, films and sheets, can also be made from the cellulosic solution.

11 Claims, No Drawings

CELLULOSE FIBER PROCESS

BACKGROUND OF THE INVENTION

The present invention relates to the spinning or other shaping of cellulosic solutions to produce filaments, fibers, films and the like.

Previously used cellulose solvents were generally sulphuric acid and phosphoric acid which tend to degrade the cellulose by causing severe hydrolysis, or complexes of heavy metals and amine compounds used in the cuprammonium process, which complexes are rather uneconomical to use because the solvent cannot be recovered directly but only in an indirect and complicated manner.

The prior art has also known other solvent complexes or solvent mixtures for cellulose. Thus, the prior art has used ferric/tartrate complexes or mixtures of dimethylsulphoxide with dimethylacetamide or nitrogen dioxide, or sulphur dioxide and an amine. Because of major technical and/or economic problems, however, such complexes or mixtures have not lead to industrial spinning processes.

The most widely used spinning process includes an initial chemical conversion of the cellulose in order to produce a soluble intermediate product, cellulose xanthate, followed by a fresh chemical conversion to regenerate the cellulose. In such a process, significant consumption of chemical reactants, and especially a major loss of carbon disulphide, is involved.

Johnson et al., IPC Technical Paper Series of The Institute of Paper Chemistry, No. 5 (April 1975), report that they are able to dissolve cellulose, at very low concentrations, mainly 1 to 3% by weight/volume, in dimethylsulphoxide (DMSO) containing a large amount of formaldehyde relative to the amount of cellulose (on the order of 5 to 20 times the weight of the cellulose). Solutions of such low concentration are completely unsuitable for shaping on an industrial scale to produce filaments, fibers, membranes, films, sponges and the like, and the yield of the process of dissolving the cellulose is extremely low, because in most cases a large undissolved residue remains, which can represent up to 37% of the weight of the pulp, which is only employed at the rate of 1% relative to the DMSO. In addition, the high paraformaldehyde content interferes with the subsequent shaping operation. The described cellulosic solutions are extruded through a syringe into a tray of methanol, to produce a fibrous product. Such a process is clearly unsuitable for industrial application, as it does not involve a rapid coagulation, compatible with a continuous spinning process, and does not produce a gel capable of withstanding the spinning tensions, and hence, does not lead to fibers of suitable properties. These authors teach that solutions of higher cellulose concentration can only be obtained from cellulose having a low degree of polymerization. As is known to the art, these celluloses of low degrees of polymerization are not found in the natural state, and can only be obtained by a prior chemical treatment of native cellulose, with consequential considerable increase in cost. Furthermore, filaments produced from celluloses having low degrees of polymerization have generally poor properties and are sometimes unsuited for textile applications.

Netherlands application No. 76/05316, published on Nov. 23, 1976, discloses the extrusion of a solution of cellulose in a mixture of DMSO and formaldehyde into a regeneration bath, which is an aqueous solution of a pH > 7 containing compounds such as ammonia or ammonium salts. It is stated that a bath of DMSO and ammonia is unsuitable. The filaments produced by the process of this application have such poor properties, and especially a very low elongation, as to be rendered unsuitable for textile applications.

U.S. Pat. application Ser. No. 815,852, filed on July 14, 1977, in the names of Jacques Menault and Henry Rodier, and commonly assigned, discloses shapeable solutions of native cellulose in DMSO and formaldehyde, wherein the cellulose has a degree of polymerization (DP) of at least 400, the solution has a cellulose concentration of at least 6% by weight of cellulose per volume of DMSO and the formaldehyde/cellulose weight ratio is between 0.2 and 2. The water content of these solutions is less than or equal to 5000 ppm by weight.

My copending application Ser. No. 815,850, filed July 14, 1977, discloses a process for producing shaped articles of cellulose, wherein a solution of cellulose in DMSO and formaldehyde, at a formaldehyde/cellulose weight ratio of 0.2 to 2, and a cellulose concentration of at least 6% by weight based on the volume of DMSO, is spun into a coagulant bath. The coagulant bath contains water, DMSO and ammonia or an ammonium salt. The DMSO is present in an amount of about 25 to 60 weight % of the mixture of DMSO and water. The ammonia or ammonium salt is present in an amount, calculated as ammonia, of at least 1 g/l in the mixture of DMSO and water.

My copending application Ser. No. 815,856, filed on July 14, 1977, discloses a process for producing shaped cellulosic articles by contacting a shaped solution of cellulose in DMSO and formaldehyde, which solution contains at least 6% by weight of cellulose, based on the volume of DMSO, and contains formaldehyde in a weight ratio of formaldehyde/cellulose of about 0.2 to about 0.6, with a coagulating solution of DMSO and water at a temperature no greater than 10° C. The coagulant bath generally contains 30 to 50% by weight of DMSO. The solutions generally coagulate in less than twenty seconds, and thus are appropriate for commercial practice.

The processes of my copending applications, mentioned above, are quite acceptable for the production of shaped cellulosic articles from cellulosic solutions, such as the solution of the aforesaid copending application Ser. No. 815,852. However, it is desired to increase the process speed, and improve the overall process economies.

SUMMARY OF THE INVENTION

The present invention relates to a continuous industrial process for the manufacture of cellulosic shaped articles, and especially cellulose fibers, with the resulting fibers having good textile properties. In addition to fibers, other shaped articles, such as films and the like, may be produced by the present process. For greater convenience, the term "spinning" will, in the following text, be used for the shaping of filaments, fibers, films and the like, and the terms "fibers" and "filaments" will be used to also include other shaped articles, such as films, sheets or the like.

The present invention allows the cellulosic fibers to be produced at increased spinning speeds, and in a more economical manner, by spinning the cellulosic solution into a gaseous atmosphere containing ammonia.

The cellulosic solutions which are spun by the process of the present invention are solutions of cellulose in DMSO and formaldehyde, which solutions contain at least 6% by weight of cellulose per volume of DMSO, and contain formaldehyde in a formaldehyde/cellulose weight ratio of about 0.2 to 2.

DETAILED DESCRIPTION OF THE PRESENT INVENTION

The solutions of cellulose in DMSO and formaldehyde which may be spun using the process of the present invention are suitably those produced by the copending application, Ser. No. 815,852, described above. The disclosure of that copending application is incorporated herein by reference.

In order to obtain filaments or fibers having good textile properties, it is decidedly preferred to utilize a cellulose having a degree of polymerization (DP) of at least 400, and more preferably between 400 and 1100, although celluloses with a higher degree of polymerization can also be used.

The formaldehyde/cellulose weight ratio of the solution of cellulose in DMSO and formaldehyde must be between 0.2 and 2. Preferably, this weight ratio is between 0.2 and 0.6, as the use of a weight ratio in this range obviates the necessity to use and especially to consume excessively high contents of ammonia in the gaseous atmosphere.

This can be achieved by dissolving the cellulose, preferably a native cellulose which has been previously dried, in a mixture of DMSO and formaldehyde in relative amounts such that the formaldehyde/cellulose weight ratio is at least 1 and preferably between 1 and 2. The formaldehyde is conveniently used in the form of paraformaldehyde. The DMSO preferably contains less than 1000 ppm of water and the less accessible the cellulose which is to be dissolved is, the lower the amount of water must be.

It is known to the art that the possibility of causing the cellulose molecules to react, or of solvating the cellulose molecules, is to a large part determined by the architecture in which the cellulose molecules are involved in the solid state. The art has characterized the ease of penetration of a reactant into the textile of a cellulose by making general resort to the concept of accessibility. Cellulose accessibility depends in a complex manner on the length of the chains of the cellulose, the mean DP, the size of the crystalline and amorphous zones and the fibrillar structure, which characterize the morphology of the cellulose fibers in question.

The formaldehyde/cellulose weight ratio depends to a large extent upon the accessibility of the cellulose which is to be dissolved to form the solution. Thus, for certain native celluloses exhibiting relatively low accessibilities, a rather high formaldehyde/cellulose weight ratio will be utilized. In general, the formaldehyde/cellulose weight ratio will increase with a decrease of the accessibility of the cellulose which is to be employed.

It is advantageous to carry out the dissolving process at an elevated temperature, preferably at 90° to 130° C., although lower or higher temperatures could be used if desired. The use of such lower or higher temperatures does not provide any advantages, however. It can be advantageous to heat the DMSO before introducing therein the cellulose which is to be dissolved.

The amount of cellulose in the solution is at least 6% weight per volume of DMSO, that is, at least 60 grams of cellulose per liter of DMSO, and can be much larger, for example, 20% w/v or more, depending upon the subsequent use to which the solution is to be put and the accessibility of the cellulose.

After the cellulose is dissolved, the formaldehyde/cellulose weight ratio may be reduced to a value of between 0.2 and 0.6, and even more preferably, between 0.2 and 0.4, by removing the free formaldehyde, or formaldehyde combined with the cellulose. This formaldehyde removal may be by any known means, including driving off the formaldehyde by entrainment in an anhydrous, preferably inert, gas, or by distillation under reduced pressure. This step of reducing the formaldehyde content can be conducted without risk of forming gels or coagulating the solution, provided that the formaldehyde/cellulose weight ratio remains at least as great as 0.2. After the formaldehyde/cellulose weight ratio has been reduced to the desired point, the amount of DMSO in the solution may be brought back to its original value.

If a cellulose having a DP of less than 400 is used, such as cellulose II, possibly derived from waste products, it is possible to dissolve the cellulose with a formaldehyde/cellulose weight ratio of less than 1, and thus it may be possible to entirely dispense with the step of removing excess formaldehyde. However, such celluloses having a DP of less than 400 are generally not suitable for the production of textile filaments having good physical properties. For this reason, the cellulose used in the solutions of the present invention will preferably have a DP of more than 400.

The gaseous atmosphere consists of a gaseous mixture which contains ammonia. Preferably, the gaseous atmosphere contains an inert gas, such as nitrogen, and small amounts of water, in form of water vapor, may be present.

The amount of ammonia contained in the gaseous atmosphere depends upon the formaldehyde content of the cellulosic solution which is to be spun, upon the extrusion speed, upon the speed of the gaseous atmosphere circulation, and upon various physical conditions, such as temperature and pressure. It is readily feasible, from simple plant experiments, to determine the optimum ammonia content for a given set of conditions of the process of the present invention. In practice, formaldehyde forms with cellulose an unstable association so that a very low amount of ammonia in the atmosphere initiates a beginning of coagulation. Generally the ammonia concentration will not exceed 0.7 g/l, expressed under normal conditions (that is, STP conditions) and can be as low as 0.03 g/l STP, for example, although for special conditions, the ammonia concentration may be higher or lower than the aforesaid range. The gaseous atmosphere is heated before introduction into the spinning chamber, and normally will be heated to a temperature of about 100° C.

Much higher temperatures can be readily utilized as long as the temperature is not high enough to adversely affect the shaping of the filaments near the spinneret. Normally, however, the temperature of the gaseous atmosphere will not exceed about 130° C.

Normally, the cellulosic solution will be at a temperature of at least 20° C. in the spinneret before contacting the coagulating gaseous atmosphere.

The gaseous atmosphere containing the ammonia will generally be circulated, and the circulation can be cocurrent or countercurrent relative to the direction of travel of the extruded filaments. The velocity of the circulated gaseous atmosphere is not critical.

Optionally, an additional amount of inert gas, which contains little or no ammonia, can be injected at a more distant point from the spinneret head, after the yarns start to exhibit a certain cohesion, to cause more rapid evaporation of the solvent, particularly the DMSO. Preferably, this additional inert gas is heated to a higher temperature, which will generally be at least 200° C. Nitrogen or other inert gas may be suitably used.

The temperature of the spinning chamber walls is preferably maintained at a rather high level, to assist the evaporation of the solvent contained in the extruded filaments. This temperature should be at least 80° C. in the upper section of the spinning chamber, located nearest the spinneret, and at least 200° C., and preferably at least 240° C., in the lower section of the spinning chamber, that is, that portion furthest from the spinneret.

If necessary or desired, the yarn leaving the spinning chamber may be washed, for example, with water, to remove residual solvent, and thereafter can be dried using standard textile drying equipment. After the washing step, the filaments may be drawn in one or more stages, and the drawing may be conducted in air, or in boiling water, or successively in both. Normally, each stage will draw the filament by 10 to 50% of its length, but this drawing step is not indespensible.

The cellulose fibers obtained by the process of the present invention exhibit good mechanical properties, of the same order of magnitude as those of regenerated cellulosic fibers intended for textile applications. However, the process of the present invention allows the cellulose fibers to be produced in a much more rapid and economical fashion, and thus represents a decided advance in the art.

EXAMPLES OF THE INVENTION

The following example, wherein percentages are expressed in weight, unless otherwise indicated, is given by way of illustration of the invention without limiting the invention.

Example 1

90 g of sulfate wood pulp, viscose grade, having a DP of 450, and a moisture content of 5.5%, were dried to a moisture content of less than 1% and the introduced into 1000 $cm^3$ of DMSO containing 600 ppm of water and 106 g of 96% strength paraformaldehyde, providing a paraformaldehyde/cellulose weight ratio of 1.20. The temperature of the mixture, which was initially at ambient temperature, was raised to 130° C. in one hour with slow stirring, and was maintained at 130° C. for three hours with continued stirring.

The temperature of the solution was then lowered to 120° C. and maintained at that temperature while a stream of nitrogen, which was also at a temperature of 120° C., was bubbled through the solution to remove a part of the formaldehyde. When the formaldehyde/cellulose weight ratio had been reduced to 0.25, the bubbling of the stream of nitrogen was ceased, and the solution was readjusted to compensate for DMSO losses. The resulting solution had a viscosity of 1100 poises at 20° C., and the dissolution of the cellulose was complete, as observed under a polarizing microscope.

The solution was extruded downward at a temperature of 25° C. through a spinneret having 48 orifices, each of 0.25 mm diameter, into a 7 m high spinning chamber having two sections, the upper section being 2 m high, and the lower section being 5 m high. The walls of the upper section were maintained at a temperature of 120° C., and the walls of the lower section were maintained at a temperature of 245° C.

A gaseous mixture which had been heated to a temperature of 105° C., and consisting of a mixture of nitrogen in which a 28% strength aqueous solution of ammonia had been previously vaporized to an ammonia content in the gaseous mixture, under normal conditions (that is, STP), of 0.10 g/l, was injected into the upper section of the spinning chamber.

Pure nitrogen, at a temperature of 245° C., was injected into the lower section of the spinning chamber.

The gas mixture in the spinning chamber was withdrawn from the lower section of the chamber, and the resulting yarns were withdrawn from the lower section of the spinning chamber at a speed of 140 m/minute, and wound at that speed onto perforated metal bobbins. Filled bobbins so obtained were washed with water at ambient temperatures to remove residual solvent, and thereafter the yarns were sized and dried. The resulting yarn exhibited the following physical characteristics (wherein the condition state refers to maintaining the filaments until equilibrium at 20° C. ± 2° C., and 65 ± 2% relative humidity):

| | |
|---|---|
| gauge | 150 dtex/48 filaments |
| tenacity after conditioning | 17 g/tex |
| elongation after conditioning | 20 % |
| wet tenacity | 12 g/tex |
| wet elongation | 27 % |

What is claimed is:

1. In a process for producing shaped articles of cellulose by extruding a solution of cellulose in dimethylsulphoxide and formaldehyde, said solution containing at least 6% by weight/volume of cellulose in dimethylsulphoxide, said solution containing formaldehyde in a formaldehyde/cellulose weight ratio of between about 0.2 and 2, the improvement comprising extruding said solution into a gaseous atmosphere containing ammonia.

2. Process of claim 1, wherein said gaseous atmosphere comprises said ammonia and at least one inert gas.

3. Process of claim 2, wherein said gaseous atmosphere contains up to 0.7 g/l (STP) of ammonia.

4. Process of claim 2, wherein said inert gas is nitrogen.

5. Process of claim 2, wherein said gaseous atmosphere contains a minor amount of water vapor.

6. Process of claim 1, wherein said gaseous atmosphere is heated to about 100° C.

7. Process of claim 1, wherein said cellulose has a degree of polymerization of at least 400.

8. Process of claim 1, wherein the formaldehyde/cellulose weight ratio of said solution is between 0.2 and 0.6.

9. Process according to claim 1, wherein the gaseous atmosphere is contained inside of a walled spinning chamber, wherein the said walls are heated to at least a temperature of 80° C.

10. Process of claim 1, wherein said shaped articles are filaments.

11. Process of claim 1, wherein said shaped articles are films or sheets.

* * * * *